US008469905B2

(12) United States Patent
Ip

(10) Patent No.: US 8,469,905 B2
(45) Date of Patent: Jun. 25, 2013

(54) ULTRASONIC FOOT MASSAGE MACHINE

(76) Inventor: Shing Cheung Ip, Hong Kong (HK)

( * ) Notice: Subject to any disclaimer, the term of this patent is extended or adjusted under 35 U.S.C. 154(b) by 0 days.

(21) Appl. No.: 13/218,460

(22) Filed: Aug. 26, 2011

(65) Prior Publication Data

US 2012/0053493 A1 Mar. 1, 2012

(30) Foreign Application Priority Data

Aug. 30, 2010 (HK) ..... 10108218.7

(51) Int. Cl.
*A61H 1/00* (2006.01)

(52) U.S. Cl.
USPC ..... 601/2

(58) Field of Classification Search
USPC ..... 601/2
See application file for complete search history.

(56) References Cited

U.S. PATENT DOCUMENTS 7,614,168 B1 * 11/2009 Zummer et al. ..... 36/141

FOREIGN PATENT DOCUMENTS

| | | | |
|---|---|---|---|
| CN | 201135180 | * | 10/2008 |
| JP | 11-347097 | * | 6/1998 |
| JP | 2000-135263 | * | 5/2000 |

* cited by examiner

*Primary Examiner* — Tse Chen
*Assistant Examiner* — Hien Nguyen

(57) ABSTRACT

An ultrasonic foot massage machine is disclosed. The ultrasonic generator arranged inside the ultrasonic foot massage machine is connected with a first ultrasonic transducer and a second ultrasonic transducer that emit ultrasonic of different frequencies, respectively. The first ultrasonic transducer and the second ultrasonic transducer are connected with a first group of ultrasonic emitters and a second group of ultrasonic emitters, respectively. The ultrasonic frequency wave directly acts upon the foot sole, which can promote the blood circulation of the whole body and relax the human body, thus treating the pain produced by problem of vein athero-obstruction.

5 Claims, 1 Drawing Sheet

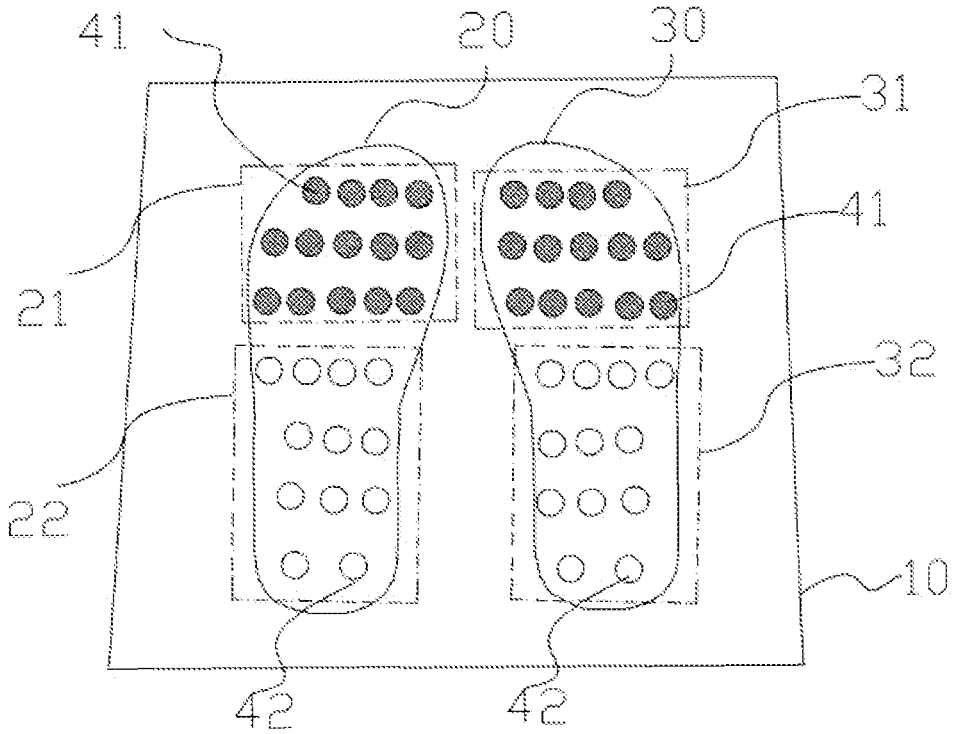
41
20
30
31
41
21
32
22
10
42
42

ULTRASONIC FOOT MASSAGE MACHINE

CROSS-REFERENCE TO RELATED APPLICATION

The present patent application claims priority of Hong Kong patent application No. 10108218.7 filed on Aug. 30, 2010, the entire content of which is hereby incorporated by reference.

FIELD OF THE PATENT APPLICATION

The present patent application relates to a health care apparatus, more specifically, to an ultrasonic foot massage machine.

BACKGROUND OF THE PATENT APPLICATION

The meridian and the viscera-state doctrines of the Chinese Medicine consider that there are meridians in a human body, which are the general designation for the meridians and the collaterals. The meridian has a meaning of path, which runs through up and down, communicates the interior and exterior of the body and acts as the mainline of the meridian system. The collateral has a meaning of meshwork, which is the branch of the meridian, smaller than the meridian and criss-crossing all over the whole body. For the meridian system, the meridian is inside, the branch of which crossing two meridians is collateral. The collaterals further branch into minute collateral which is the smallest one among all collaterals.

The doctrine of the Western Medicine considers that for the blood circulation, the blood is pumped out by the ventricle, outputted to each organ and periphery of each limb of the human body by the aorta and guided back to flow back to the ventricle by means of the cardinal vein. The transverse shunt capillaries for supplying muscle in each limb convert into nano-vein fine vessels, reflux to limb veins and hepatic veins. If each limb vein is athero-obstructed, courbature and arthralgia will be caused. A variety of symptoms such as endocrine dyscrasia and viscera dyssecretosis will be caused as well.

For example, because of the hepatic vein dilatation caused by the reflux in the body and the change of weather such as a rainy and cloudy day, the moisture pressure in the air sinks, a rheumatoid arthritis patient feels a pain of downward pressure in each articulation. If a masseur massages his body, the patient will feel tingle, numb, swollen and painful. At the same time, the pain that the limbs are pressed can also be felt.

The present Chinese Medicine therapy and Western Medicine therapy can only relieve the pain at most, neither of which can help the patients to cure the pain caused by above mentioned problem of vein athero-obstruction drastically.

SUMMARY

The objective of the present patent application is to provide an ultrasonic foot massage machine which can be used to treat the pain caused by the problem of vein ather-obstruction, aiming at the above mentioned drawbacks of the prior art.

According to an aspect, an ultrasonic foot massage machine comprising a housing is constructed, wherein a massage panel for left foot and a massage panel for right foot are arranged on the upper surface of the housing, and an ultrasonic generator and a control device for controlling the ultrasonic generator are arranged inside the housing; wherein the ultrasonic generator is connected with a first ultrasonic transducer and a second ultrasonic transducer that emit ultrasonic of different frequencies, respectively; the first ultrasonic transducer is connected with a first group of ultrasonic emitters and the second ultrasonic transducer is connected with a second group of ultrasonic emitters;

the first group of ultrasonic emitters is divided into two equivalent subgroups of emitters which are arranged in the front sole of the foot on the massage panel for left foot and in the front sole of the foot on the massage panel for right foot, respectively;

the second group of ultrasonic emitters is also divided into two equivalent subgroups of emitters which are arranged in the rear sole of the foot on the massage panel for left foot and in the rear sole of the foot on the massage panel for right foot, respectively.

In the ultrasonic foot massage machine of the present patent application, wherein the number of the emitter in the first group of ultrasonic emitters is different from that of the emitter in the second group of ultrasonic emitters.

In the ultrasonic foot massage machine of the present patent application, wherein the first group of ultrasonic emitters comprises twenty-eight emitters; wherein fourteen emitters are arranged in the front sole of the foot on the massage panel for left foot while the other fourteen emitters are arranged in the front sole of the foot on the massage panel for right foot.

In the ultrasonic foot massage machine of the present patent application, wherein the second group of ultrasonic emitters comprises twenty-four emitters; wherein twelve emitters are arranged in the rear sole of the foot on the massage panel for left foot while the other twelve emitters are arranged in the rear sole of the foot on the massage panel for right foot.

In the ultrasonic foot massage machine of the present patent application, wherein the frequency of the ultrasonic emitted by each emitter in the first group of ultrasonic emitters is 40 KHz.

In the ultrasonic foot massage machine of the present patent application, wherein the emitters in the first group of ultrasonic emitters and the second group of ultrasonic emitters comprise a copper sheet, the swing of which produces mechanical waves and electromagnetic waves.

In the ultrasonic foot massage machine of the present patent application, wherein the ultrasonic foot massage machine also comprises guide rails which are arranged on the massage panel for left foot and the massage panel for right panel along the trend of the vessels in the foot sole and used for conducting the mechanical waves and the electromagnetic waves.

In the ultrasonic foot massage machine of the present patent application, wherein the fourteen emitters in the front sole of the foot on the massage panel for left foot form three lines along the direction from toes to the sole of the foot; the numbers of the emitter in each line are 4, 5 and 5 in turn;

the twelve emitters in the rear sole of the foot on the massage panel for left foot form four lines along the direction from the heel to the sole of the foot; the numbers of the emitter in each line are 2, 3, 3 and 4 in turn;

the arrangement of the emitters on the massage panel for right foot is the same as that on the massage panel for left foot.

In order to further promote the blood circulation of both feet and relax the human body, the ultrasonic foot massage machine of the present patent application emits ultrasonic of different frequencies to the positions of the front sole of the foot and the rear sole of the foot by arranging ultrasonic emitters of different numbers respectively at the location corresponding to the front sole of the foot and the rear sole of the foot and controlling through two ultrasonic transducers respectively, thus treating the pain caused by the problem of vein athero-obstruction.

Further, guide rails are also arranged on the massage panel for left foot and on the massage panel for right foot, respectively, in the present patent application. The guide rails conduct the mechanical waves and the electromagnetic waves produced by emitters along the flow direction of blood to further promote the valve deposit of the vascular wall and the deposit of the lymph valve that obstruct the vascular wall to flow back to the vessels and make the channel capacity of the vascular wall and the flow recover to normal level, thus treating the pain caused by the problem of vein athero-obstruction.

In addition to be used for massaging both feet, the ultrasonic foot massage machine of the present patent application can also be used for massaging other parts of the body only by placing the parts that need to be massaged on the ultrasonic emitter. The other parts of the body, such as both hands, both legs and so on can be massaged to promote the blood circulation of both hands and both legs, thus driving the blood circulation of the whole body.

BRIEF DESCRIPTION OF THE DRAWINGS

The present patent application will be further described in the following with reference to the accompanying drawings and embodiments. In the figures:

FIG. 1 is a structure diagram for the ultrasonic foot massage machine according to the embodiment of the present patent application.

DETAILED DESCRIPTION OF THE PREFERRED EMBODIMENT

The structure of the ultrasonic foot massage machine according to the embodiment of the present patent application is as shown in FIG. 1. The massage machine comprises a housing 10. A massage panel for left foot 20 and a massage panel for right foot 30 are arranged on the upper surface of the housing 10, and an ultrasonic generator and a control device (not shown) for controlling the ultrasonic generator are arranged inside the housing 10. Wherein the ultrasonic generator is connected with a first ultrasonic transducer and a second ultrasonic transducer that emits ultrasonic of different frequencies, respectively. The first ultrasonic transducer is connected with a first group of ultrasonic emitters 41 (the individual emitter in the first group of ultrasonic emitters 41 is denoted by the circle with shadow in FIG. 1). The second ultrasonic transducer is connected with a second group of ultrasonic emitters 42 (the individual emitter in the second group of ultrasonic emitters 42 is denoted by the blank circle in FIG. 1), respectively. As shown in FIG. 1, the first group of ultrasonic emitters 41 is divided into two equivalent subgroups of emitters which are arranged in the front sole of the foot 21 on the massage panel for left foot 20 (which is marked by a dotted line frame in FIG. 1) and in the front sole of the foot 31 on the massage panel for right foot 30 (which is marked by a dotted line frame in FIG. 1), respectively. The second group of ultrasonic emitters 42 is also divided into two equivalent subgroups of emitters which are arranged in the rear sole of the foot 22 on the massage panel for left foot 20 and in the rear sole of the foot 32 on the massage panel for right foot 30, respectively.

Wherein the control device inside the housing 10 can drive the ultrasonic emitters in the front and rear soles of the foot to emit ultrasonic by controlling the ultrasonic generator, the first ultrasonic transducer and the second ultrasonic transducer in accordance with the pre-defined control procedures. The vibration frequency wave of the ultrasonic is transmitted into skin through the foot sole while the audio frequency wave and the electromagnetic wave vibrate the vein in the subcutis, which can influence the valve deposit of the vascular wall and the obstruction to the reflux channel of the vascular wall by the limp valve, make the channel capacity of the vascular wall and the flow recover to normal level and promote the blood circulation, thus treating the pain caused by the problem of vein athero-obstruction.

In the above embodiments, as shown in FIG. 1, the number of the emitters in the first group of ultrasonic emitters 41 is preferably different from that of the emitter in the second group of ultrasonic emitters 42. In order to further promote the blood circulation of both feet and relax the human body, ultrasonic of different frequencies is emitted to the positions of the front sole of the foot and the rear sole of the foot by arranging ultrasonic emitters of different numbers respectively at the locations corresponding to the front sole of the foot and the rear sole of the foot and controlling through two ultrasonic transducers respectively, thus treating the pain caused by the problem of vein athero-obstruction.

More preferably, according to the distribution of vessels and meridians in the foot sole, the first group of ultrasonic emitters 41 is set to comprise twenty-eight emitters, fourteen of which are arranged in the front sole of the foot 21 on the massage panel for left foot 20 while the other fourteen of which are arranged in the front sole of the foot 31 on the massage panel for right foot 30. The second group of ultrasonic emitters 42 is set to comprise twenty-four emitters, twelve of which are arranged in the rear sole of the foot 22 on the massage panel for left foot 20 while the other twelve of which are arranged in the rear sole of the foot 32 on the massage panel for right foot 30. The size and shape of the individual emitter in the two groups of ultrasonic emitters are preferred to make the human body most comfortable.

In the above embodiments, as shown in FIG. 1, according to the distribution regularity of the foot reflection area, the fourteen emitters in the front sole of the foot 21 on the massage panel for left foot 20 preferably form three lines along the direction from the toe to the sole of the foot. The numbers of the emitters in each line are 4, 5 and 5 in turn. The twelve emitters in the rear sole of the foot 22 on the massage panel for left foot 20 preferably form four lines along the direction from the heel to the sole of the foot. The numbers of the emitters in each line are 2, 3, 3 and 4 in turn. The arrangement of the emitters on the massage panel for right foot 30 is the same as that on the massage panel for left foot 20. In this way, a best massage effect can be achieved, thus treating the pain caused by the problem of vein athero-obstruction.

In the above embodiments, the frequency of the ultrasonic emitted by each emitter in the first group of ultrasonic emitters 41 is preferably 40 KHz. The frequency of the ultrasonic emitted by the second group of ultrasonic emitters 42 is preferably different from that emitted by the first group of ultrasonic emitters 41.

In the above embodiments, the emitters in the first group of ultrasonic emitters 41 and in the second group of ultrasonic emitters 42 comprise a copper sheet, the swing of which produces mechanical waves and electromagnetic waves.

The ultrasonic foot massage machine of the present patent application also comprises guide rails which are arranged on the massage panel for left foot 20 and the massage panel for right panel 30 along the trend of the vessels in the foot sole and used for conducting the mechanical waves and the electromagnetic waves (not shown). The guide rails are arranged on the massage panel for left foot 20 and on the massage panel for right foot 30, respectively. The guide rails conduct the mechanical waves and the electromagnetic waves produced by emitters along the flow direction of blood to further promote the valve deposit of the vascular wall and the deposit of the lymph valve that obstructs the vascular wall to flow back to the vessels and make the channel capacity of the vascular wall and the flow recover to normal level, thus treating the pain caused by the problem of vein athero-obstruction.

When using the ultrasonic foot massage machine of the present patent application, only need to place both feet on the massage panel for left foot 20 and on the massage panel for right foot 30. After the switch is activated, the control device will control the ultrasonic generator and the ultrasonic transducer to produce the ultrasonic in accordance with pre-set procedure and the produced ultrasonic is transmitted to the foot sole by the emitters. The produced ultrasonic passes through the skin of the foot sole, acts upon the vessels in each foot reflection area and promotes the movement of the deposit of each vascular wall, such as the deposit of the vein, particularly the deposit on the vein valve. Such deposits are further degraded by urinary system and hepatic vein while the produced uric acid crystal is discharged by urethra. Meanwhile, the peripheral capillaries around the veins can reflux to the main vein, thus treating the pain caused by the problem of vein athero-obstruction.

The ultrasonic foot massage machine of the present patent application can divide the reflection areas corresponding to the left and right feet into two parts, i.e. the front sole of the foot and the rear sole of the foot, regardless of the sizes of the feet. The sound wave frequency emitted by virtue of the ultrasonic directly stimulates the subcutaneous vessel circulation, drives the deposit of the vascular wall, in particularly the deposit on the vein valve, enhances the flow function of the vein valve and promotes the blood reflux, thus treating the pain caused by the problem of vein athero-obstruction.

In addition to be used for massaging both feet, the ultrasonic foot massage machine of the present patent application can also be used for massaging other parts of the body only by placing the parts that need to be massaged on the ultrasonic emitter. The other parts of the body are such as both hands, both legs and so on to promote the blood circulation of both hands and both legs, thus driving the blood circulation of the whole body.

It should be understood that improvements and equivalents can be made according to the above mentioned description for the ordinary skills in the art while all these improvements and equivalents should be belonged to the scope of the appended claims of the present patent application.

What is claimed is:

1. An ultrasonic foot massage machine, comprising a housing, wherein; a massage panel for left foot and a massage panel for right foot are arranged on the upper surface of said housing, an ultrasonic generator and a control device for controlling said ultrasonic generator are arranged inside said housing; wherein said ultrasonic generator is connected with a first ultrasonic transducer and a second ultrasonic transducer that emit ultrasonic of different frequencies, respectively; said first ultrasonic transducer is connected with a first group of ultrasonic emitters and said second ultrasonic transducer is connected with a second group of ultrasonic emitters;

said first group of ultrasonic emitters is divided into two equivalent subgroups of emitters which are arranged in the front sole of the foot on said massage panel for left foot and the front sole of the foot on said massage panel for right foot, respectively;

said second group of ultrasonic emitters is also divided into two equivalent subgroups of emitters which are arranged in the rear sole of the foot on said massage panel for left foot and the rear sole of the foot on said massage panel for right foot, respectively;

wherein the number of emitters in said first group of ultrasonic emitters is different from that of the emitters in said second group of ultrasonic emitters;

said first group of ultrasonic emitters comprises twenty-eight emitters; wherein fourteen emitters are arranged in the front sole of the foot on said massage panel for left foot while the other fourteen emitters are arranged in the front sole of the foot on said massage panel for right foot;

said second group of ultrasonic emitters comprises twenty-four emitters; wherein twelve emitters are arranged in the rear sole of the foot on said massage panel for left foot while the other twelve emitters are arranged in the rear sole of the foot on said massage panel for right;

in such a way, ultrasonic of different frequencies is emitted to the positions of the front sole of the foot and the rear sole of the foot, thus treating pain caused by the problem of vein athero-obstruction.

2. The ultrasonic foot massage machine of claim 1, wherein the frequency of the ultrasonic emitted by each emitter in said first group of ultrasonic emitters is 40 KHz.

3. The ultrasonic foot massage machine of claim 2, wherein the emitters in said first group of ultrasonic emitters and said second group of ultrasonic emitters comprise a copper sheet, the swing of which produces mechanical waves and electromagnetic waves.

4. The ultrasonic foot massage machine of claim 3, wherein the ultrasonic foot massage machine also comprises guide rails which are arranged on said massage panel for left foot and on said massage panel for right panel along the trend of the vessels in the sole of the foot and used for conducting said mechanical waves and electromagnetic waves.

5. The ultrasonic foot massage machine of claim 4, wherein the fourteen emitters in the front sole of the foot on said massage panel for left foot form three lines along the direction from the toe to the sole of the foot; the numbers of the emitters in each line are 4, 5 and 5 in turn;

the twelve emitters in the rear sole of the foot on said massage panel for left foot form four lines along the direction from the heel to the sole of the foot; the numbers of the emitters in each line are 2, 3, 3 and 4 in turn;

the arrangement of the emitters on said massage panel for right foot is the same as that on said massage panel for left foot.

* * * * *